US005419499A

United States Patent [19]

Bourne

[11] Patent Number: 5,419,499

[45] Date of Patent: May 30, 1995

[54] TREATMENT OF PARTICULATE MATERIAL

[76] Inventor: Ronald F. Bourne, 1095 Kelvin Drive, Sandton, Transvaal, South Africa

[21] Appl. No.: 203,600

[22] Filed: Feb. 28, 1994

Related U.S. Application Data

[63] Continuation of Ser. No. 834,106, Feb. 13, 1992, abandoned.

[30] Foreign Application Priority Data

Feb. 15, 1991 [ZA] South Africa ..... 91/1137

[51] Int. Cl.[6] ..... B02C 23/32; B02C 23/34

[52] U.S. Cl. ..... 241/18; 241/55; 241/58; 241/188.1; 241/191

[58] Field of Search ..... 241/18, 27, 47, 55, 241/58, 188.1, 189.1, 191

[56] References Cited

U.S. PATENT DOCUMENTS

| | | | |
|---|---|---|---|
| 1,875,817 | 9/1932 | London | 241/58 |
| 2,361,278 | 10/1944 | Evans | 241/188.1 X |
| 2,939,638 | 7/1960 | Haigh et al. | 241/188.1 X |
| 3,384,139 | 5/1968 | Schnell | 241/47 |
| 3,700,177 | 10/1972 | Pearson | 241/55 X |
| 3,784,117 | 1/1974 | Roerig et al. | 241/191 |
| 3,873,034 | 3/1975 | Iwahori et al. | 241/55 |
| 3,887,141 | 6/1975 | Francis | 241/189.1 X |
| 4,002,462 | 1/1977 | Maddox | 241/18 |
| 4,037,796 | 7/1977 | Francis | 241/189.1 X |
| 4,428,536 | 1/1984 | Rodgers | 241/188.1 X |
| 4,479,613 | 10/1984 | Rowledge | 241/189.1 X |
| 4,767,066 | 8/1988 | Williams | 241/27 |

FOREIGN PATENT DOCUMENTS

| | | | |
|---|---|---|---|
| 200464 | 7/1955 | Australia | 241/58 |
| 81245 | 11/1951 | Czechoslovakia | 241/188.1 |
| 718381 | 3/1942 | Germany | 241/189 R |
| 1141863 | 12/1962 | Germany | 241/191 |
| 1207189 | 12/1965 | Germany | 241/189 R |
| 2729926 | 1/1979 | Germany | 241/191 |
| 2742232 | 2/1979 | Germany | 241/191 |
| 3203324 | 8/1983 | Germany | 241/191 |
| 3926203A1 | 2/1990 | Germany . | |
| 255882 | 2/1949 | Switzerland | 241/188.1 |
| 196487 | 4/1923 | United Kingdom . | |
| 790652 | 2/1958 | United Kingdom . | |
| 911059 | 11/1962 | United Kingdom | 241/191 |
| 958484 | 5/1964 | United Kingdom . | |
| 1337483 | 11/1973 | United Kingdom . | |
| 1397674 | 6/1975 | United Kingdom . | |
| 2053726 | 2/1981 | United Kingdom . | |
| 2198060 | 6/1988 | United Kingdom . | |
| 2230971 | 11/1990 | United Kingdom . | |
| 1042798 | 9/1983 | U.S.S.R. | 241/189 R |
| 1445779 | 12/1988 | U.S.S.R. | 241/188.1 |
| 1509113 | 9/1989 | U.S.S.R. | 241/188.1 |
| 8805340 | 7/1988 | WIPO | 241/189 R |

*Primary Examiner*—Frances Han
*Attorney, Agent, or Firm*—Nikaido, Marmelstein, Murray & Oram

[57] ABSTRACT

The invention provides a mill or classifier includes a rotor with a plurality of outwardly radiating beater elements which is mounted for rotation within a housing. The housing defines an upper level inlet for raw material and one or more outlets for treated material. An expansion chamber is provided into which material is thrown by the beater elements of the rotor in use.

26 Claims, 12 Drawing Sheets

FIG.7
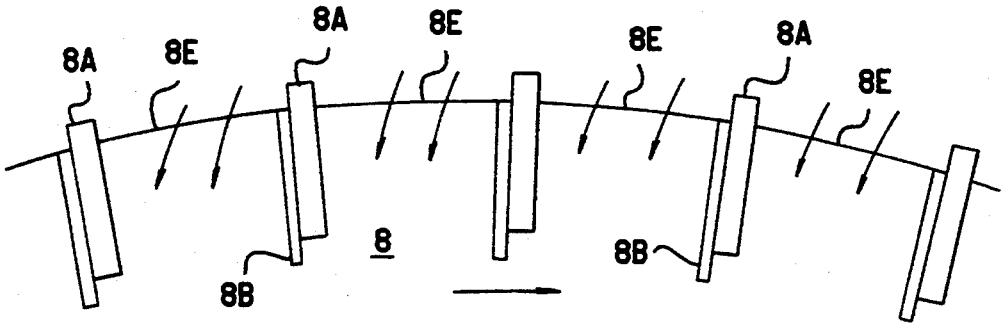
FIG.8
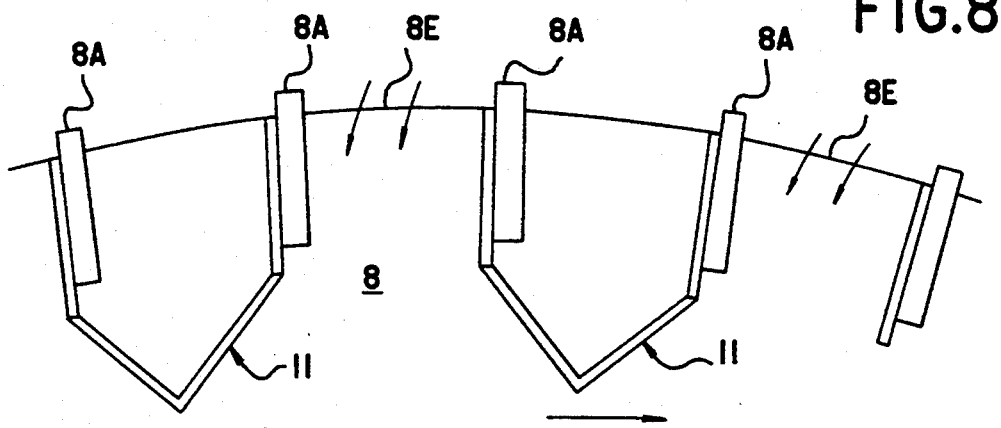
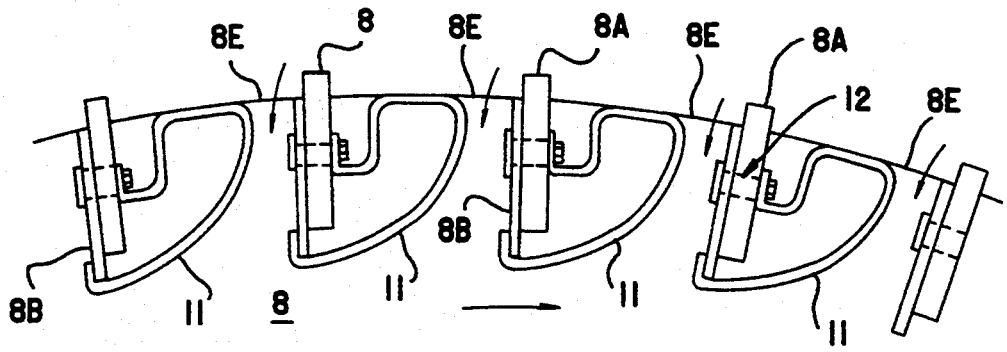
FIG.9

FIG.13
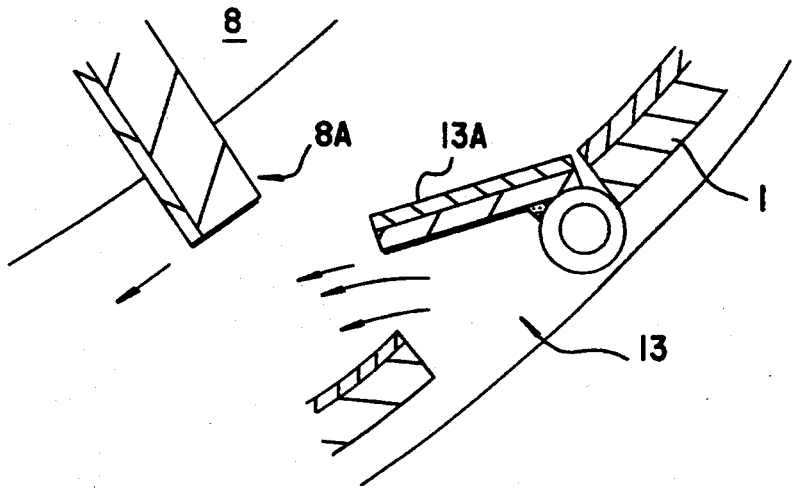
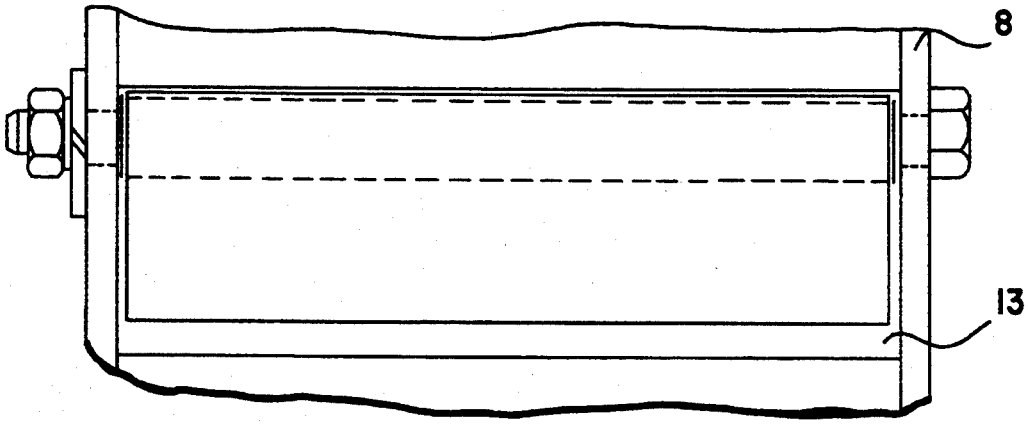
FIG.14

TREATMENT OF PARTICULATE MATERIAL

This application is a continuation of application Ser. No. 07/834,106 filed Feb. 13, 1992 now abandoned.

FIELD OF THE INVENTION

This invention relates to the treatment of particulate material by way of grinding, classification or the like.

BACKGROUND OF THE INVENTION

Conventional rotary machines such as impact or attrition mills and the like suffer from the following disadvantages.

[1] Due to centrifugal force material tends to form a compacted layer on the inner periphery of the mill;

[2] As a result of the condition in [1] above, excessive grinding of material producing unnecessary or excessive fines commonly takes place;

[3] As a result of the condition [1] described above, difficulties are experienced in separating finer and coarser material;

[4] Throughput of the mill is hampered as a result of the compaction described in [1] above and the difficulty described in [3] above;

[5] Wear of certain parts of the mills is increased as a result of the conditions [2] and [3], described above.

SUMMARY OF THE INVENTION

It is accordingly an object of the present invention to provide a novel method and means for milling, classifying and the like which it is believed will overcome or at least minimize the difficulties set out above.

A further object of the invention is to provide a versatile unit which can be used in different modes as follows to provide a wide range of classified products.

(a) As an impact mill (b) As a differential impact mill (c) As an attrition mill (d) As a differential attrition mill (e) As an air classifier.

It will be appreciated that different materials have physical characteristics which vary considerably particularly in respect of grindability and the invention has as an objective to provide a novel system which gives the necessary flexibility in performing the above functions on most dry friable materials within the basic framework and construction of the unit disclosed hereunder.

According to the invention such a mill, classifier or the like comprises a rotor which carries a plurality of outwardly radiating beater elements and which is mounted for rotation within a housing, the latter defining an inlet located on an upper level of the housing for raw material and one or more outlets for treated material, characterised in an expansion chamber into which material is thrown by the rotor in use. Preferably the expansion chamber will be disposed at the upper level of the housing and the inlet will communicate with the expansion chamber.

Further according to the invention an expansion chamber defines one or more partitions disposed generally parallel to the plane of the rotor.

Where the apparatus of the invention is adapted to act as an impact or attrition mill, one or more radial or inclined plates generally parallel to the axis of rotation of the rotor will preferably also be provided to act as stationary impact plates. Where the apparatus of the invention is adapted to act as a differential mill or an air classifier one or more adjustable inclined or curved plates will preferably be provided as stationary guide plates in the expansion chamber to guide the unclassified material between the radial partitions in the direction of rotation of the rotor to minimize impact between the material, the rotor and the casing.

Still further according to the invention the outlet is axially disposed and adapted to be coupled to suction means for drawing treated material through a rotating outlet. In a preferred arrangement the rotating outlet will be incorporated in the rotor of the device. Thus, in a preferred construction the rotor will define arm or plate members for carrying the beaters and which are flanked by front and rear side discs of the rotor define an air passage between adjacent arm members, the passages defining openings at the extremities of the arm members down which the sized material may be drawn.

It is also envisaged that the beaters and beater support arms of the rotor may be radially disposed or alternatively could be arranged with forward or backwardly inclined at an angle to assist in withdrawing a larger classified maximum particle size or a small classifier maximum particle size respectively.

In an alternative arrangement the front and rear side discs may be disposed with and the arm members be of tubular construction each defining an air passage through which sized material may be withdrawn.

A feature of the invention provides for airflow through the mill or classifier to be such that sized material can readily be withdrawn as it is created. Thus the invention envisages that controlled upper level air inlets will be provided in the expansion chamber to direct air tangentially about the rotor, opposed axial inlets to direct the airflow from the axis of the rotor radially outwardly, and, in the case of the air classifier, one or more controlled peripheral inlets in the housing of the device to wash material away from the periphery of the housing.

In all modes the factors that control the classification of the particles include the rotor speed and the air velocity down the air passages in the rotor. In all mill modes the rate of grinding of the feed material in the mill is a function of rotor speed and in all modes the air quantity passing through the mill must be sufficient to convey the product. In certain cases the product produced by the mill may be too fine yet the air quantity may not be easily increased sufficiently to rectify this and, at the same time, the mill rotor speed cannot be reduced without reducing the production rate due to the grindability of the material being treated. Thus further according to the invention the area of the air inlet openings at or towards the extremities of the arm members is preferably variable by providing removable fairings or the like at the zones. Since these inlet air velocities are usually high, these fairings will preferably provide a streamlined low resistance streamlined entry at these rotor air inlets.

Where the apparatus of the invention is adapted to act as a differential mill or where it is adapted as an air classifier, an outlet for oversize, denser or harder material will also be provided at a lower level in the housing, the arrangement being one wherein the material is airwashed as it passes through the outlet. It is envisaged that control vanes will be provided at such an outlet, one control vane directing material towards the outlet while another will be adapted to direct airflow into the housing.

According to whether the apparatus is used in impact mill mode, attrition mill mode or air classifier mode so the liners will be arranged for impact, attrition or for negligible reduction respectively.

Also included within the scope of the invention is a method of milling comprising the steps of providing a mill having a rotor including a plurality of outwardly radiating beater elements rotatably mounted within a housing, the housing defining an expansion chamber located at an upper level of the housing, introducing raw material into the housing, and causing the beater elements to throw the raw material into the expansion chamber repeatedly during the milling process.

The invention further includes within its scope a method of classifying comprising the steps of providing a mill having a rotor including a plurality of outwardly radiating beater elements rotatably mounted within a housing, the housing defining an expansion chamber located at an upper level of the housing, and introducing raw material into the housing along a pathway extending in the direction of rotation of the rotor.

Still further according to the invention a method of milling or classifying includes the steps of withdrawing sized material from the casing co-axially with the axis of rotation of the rotor, such sized material being withdrawn along passages extending from the outer periphery of the rotor towards the axis thereof.

Yet further according to the invention a method of milling or classification includes the steps of introducing air into the housing from the zone of the axis of rotation of the rotor for flow outwardly toward the periphery of the rotor.

Further still according to the invention a method of milling or classification may include the step of introducing air into the casing at high level for circular flow in conjunction with the outer peripheral zone of the rotor.

A method of classifying according to the invention may include the further step of introducing air into the casing at a lower level to wash material away from the lower peripheral zones of the casing.

DESCRIPTION OF THE DRAWINGS

The invention thus provides a versatile arrangement which is described below purely by way of example with reference to the accompanying drawings wherein:

FIGS. 7, 8, and 9 are diagrammatic elevations of rotor beaters, beater supports and fairings on three different rotors of the apparatus in FIG. 1;

FIGS. 13 and 14 are a schematic section and a plan view of an adjustable peripheral air inlet;

DESCRIPTION OF THE PREFERRED EMBODIMENTS

Figure 1:
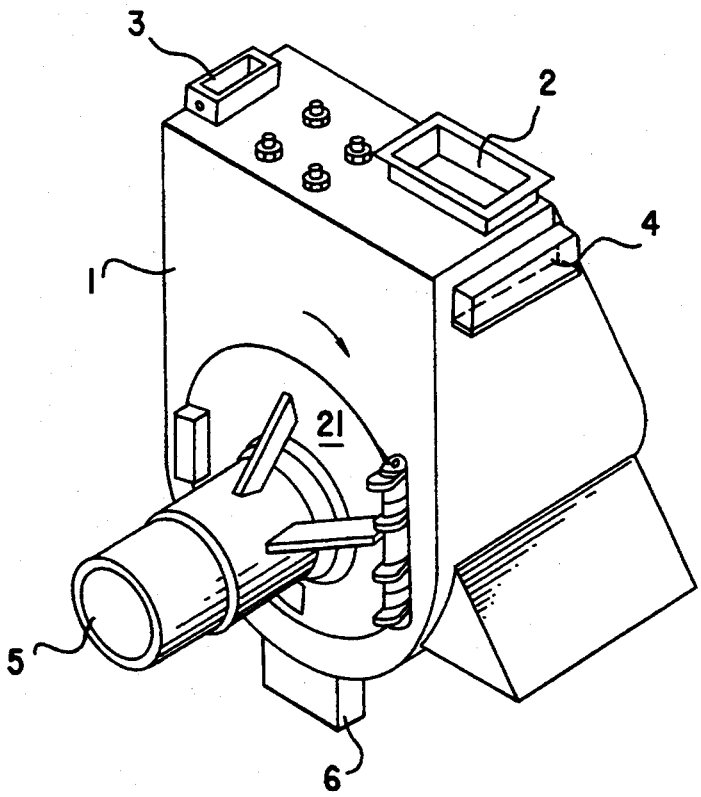
FIG. 1 is a schematic perspective view of the apparatus in accordance with the invention.
Figure 2:
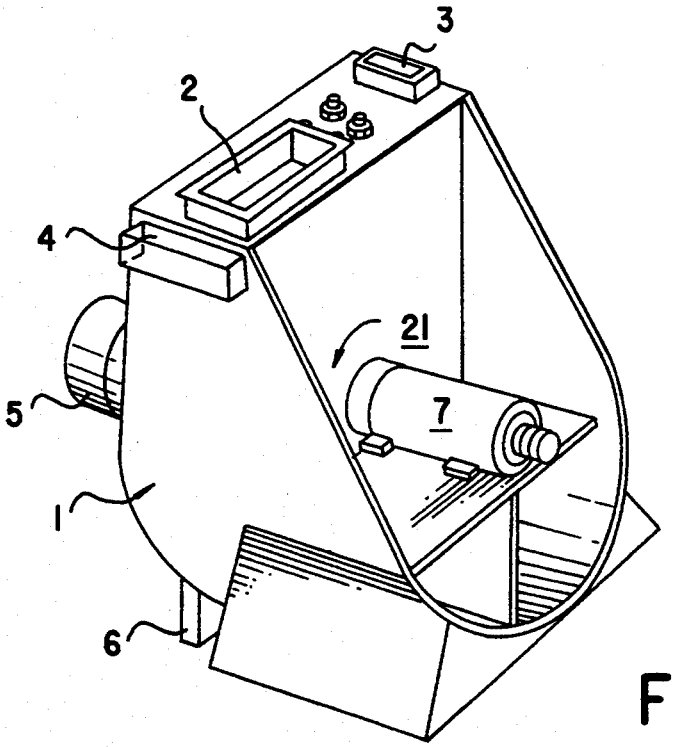
FIG. 2 is a schematic perspective view of the apparatus in FIG. 1 from opposed perspective.

Referring to the drawings, the device, in accordance with the invention, for the treatment of particulate material is characterised in that it can be readily converted from an impact mill to a differential impact mill, to an attrition mill, to a differential attrition mill or to an air classifier. It can also be arranged to grind a coarse or an extremely fine product.

Generally, in impact mill mode, the action is restricted to one of impact with a minimum of attrition so that the resulting product contains not only a sized maximum particle size through the classification action of the rotor but a maximum quantity of larger particle sizes and a minimum quantity of smaller particle sizes. Normally the speed of rotation of the rotor would be low and the centrifugal force on the particles small.

In differential impact mill mode, the aim is the same but there is an additional action in the extraction of larger, denser or harder particles via the lower level outlet of the unit.

Generally the action in impact mill mode is not so severe as in the attrition mill mode; less reduction is aimed for and usually the speed of the rotor would be lower. However, it will be appreciated that the inherent physical properties of the material being treated affect the product considerably. Generally also the impact mill mode will create the greatest production rate, the lowest power consumption per unit of production rate and the lowest wear of beaters and liners per unit mass of production.

Generally, the action of the device in attrition mill mode is to provide a more severe attrition action so that a fine product is achieved below a chosen maximum particle size which is smaller than in compact mill mode. Production rate is generally lower with a higher power consumption per unit of production rate. In differential attrition mill mode, larger, denser or harder particles are separated out via the lower level outlet. This material is separated out before it is ground finer either because it is undesirable in the fine product or because it is useful; in any case, since it is usually more abrasive than the softer or lighter material, its extraction can increase the production rate of the fines and reduce wear considerably.

It should be noted that, provided the feed material is not extremely friable when the apparatus is set to grind extremely fine, the product can still consist mainly of particles which are only just below the chosen classified maximum size. This is due to the expansion chambers and the air entry points enabling the sized particles to emerge as soon as they are created without undue retention.

In air classifier mode, the apparatus will effectively split a feed of ground material into a larger fraction via the lower level outlet with the finer fraction classified out and conveyed in the airflow from the unit. The classification action of the rotor is such that a very accurate split a chosen particle size can be achieved. Factors affecting the split are the air velocity radially down the air paths in the rotor and the rotational speed of the rotor.

In air classification mode, the aim is not normally a further reduction in the size of the particles of the feed material but to merely split it into the two fractions; in this case, therefor, steps are taken to reduce both impact and attrition and liners, for example, would normally be smooth faced. In this mode, feed rates can be considerable increased especially where the quantity of the larger fraction exceeds that of the smaller since it passes straight out through the lower level outlet. Power consumption is invariably low.

With reference to FIGS. 1 to 21 a unit in accordance with the invention comprises a housing 1 preferably of a U-shape configuration in elevation as shown in the illustrations. The housing defining an upper level inlet 2 for particulate material and an axial outlet 5 for treated material which is described in more detail below. Rotatably mounted within the housing 1 is a rotor 8 which defines a plurality of generally radially extending arm members 8B with their leading faces mounting beater elements 8A of suitably wear resistant material, the beater elements 8A being secured to the arm members 8B by spigots 12 (see FIG. 5). It is a feature of the invention that the rotor 8 could be of hollow constructions between a front disc 8C and a rear disc 8D whereby passages 8F for treated material are defined between adjacent radially extending arm members 8B with an entry 8E for material being defined at the outer extremity of each arm member 8B. With this arrangement the axial outlet duct 5 described above will communicate with the interior central zone of the rotor 8 so that an outlet passage for treated material is defined from the outer extremities 8E of rotor arms 8B down the spaces 8F and along the duct 5 to a suitable material collecting device such as a filter shown schematically at 18 in FIG. 20 or a cyclone collector 26 in closed circuit in FIG. 21.

Figure 5A:
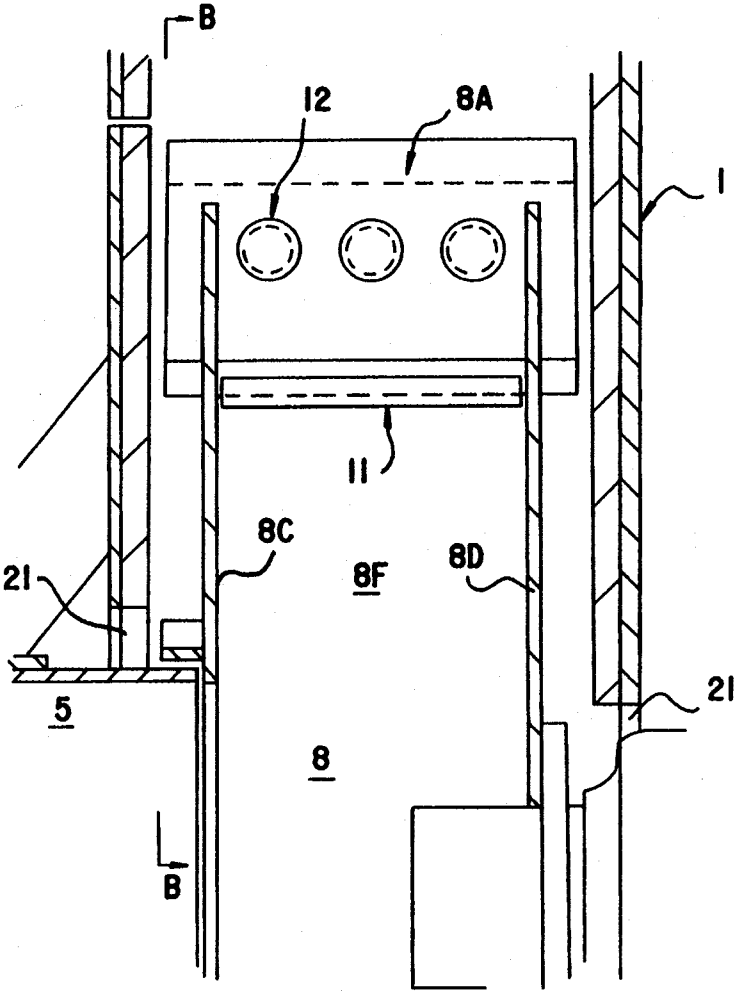
FIGS. 5 and 5A is an enlarged schematic side view and an end section respectively of a rotor fairing forming part of the apparatus in FIG. 1.
Figure 5:
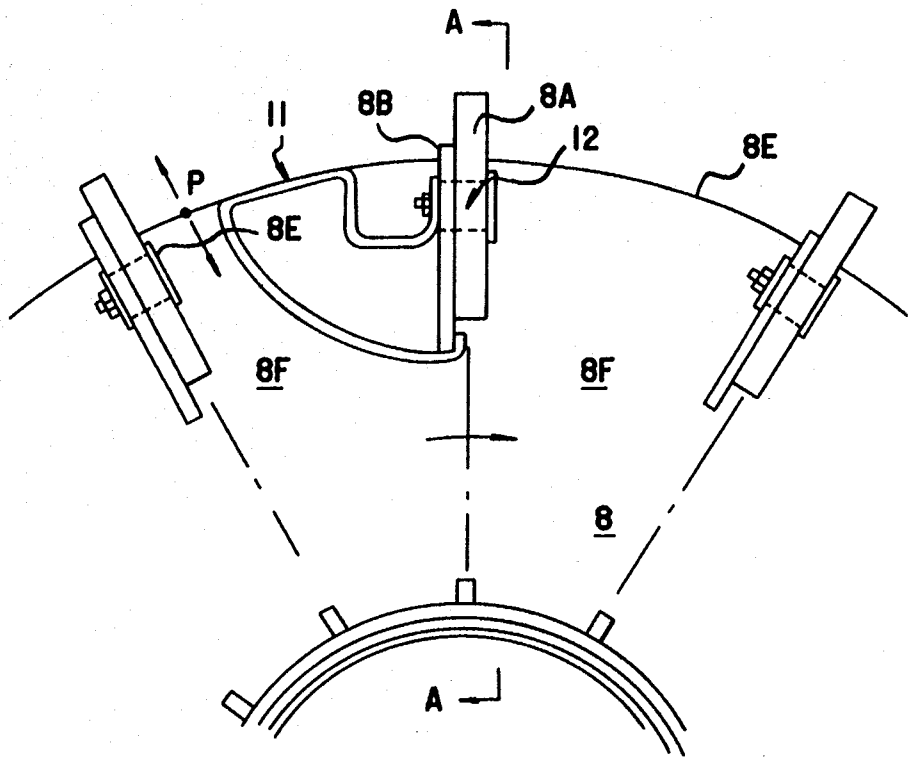
Figure 20:
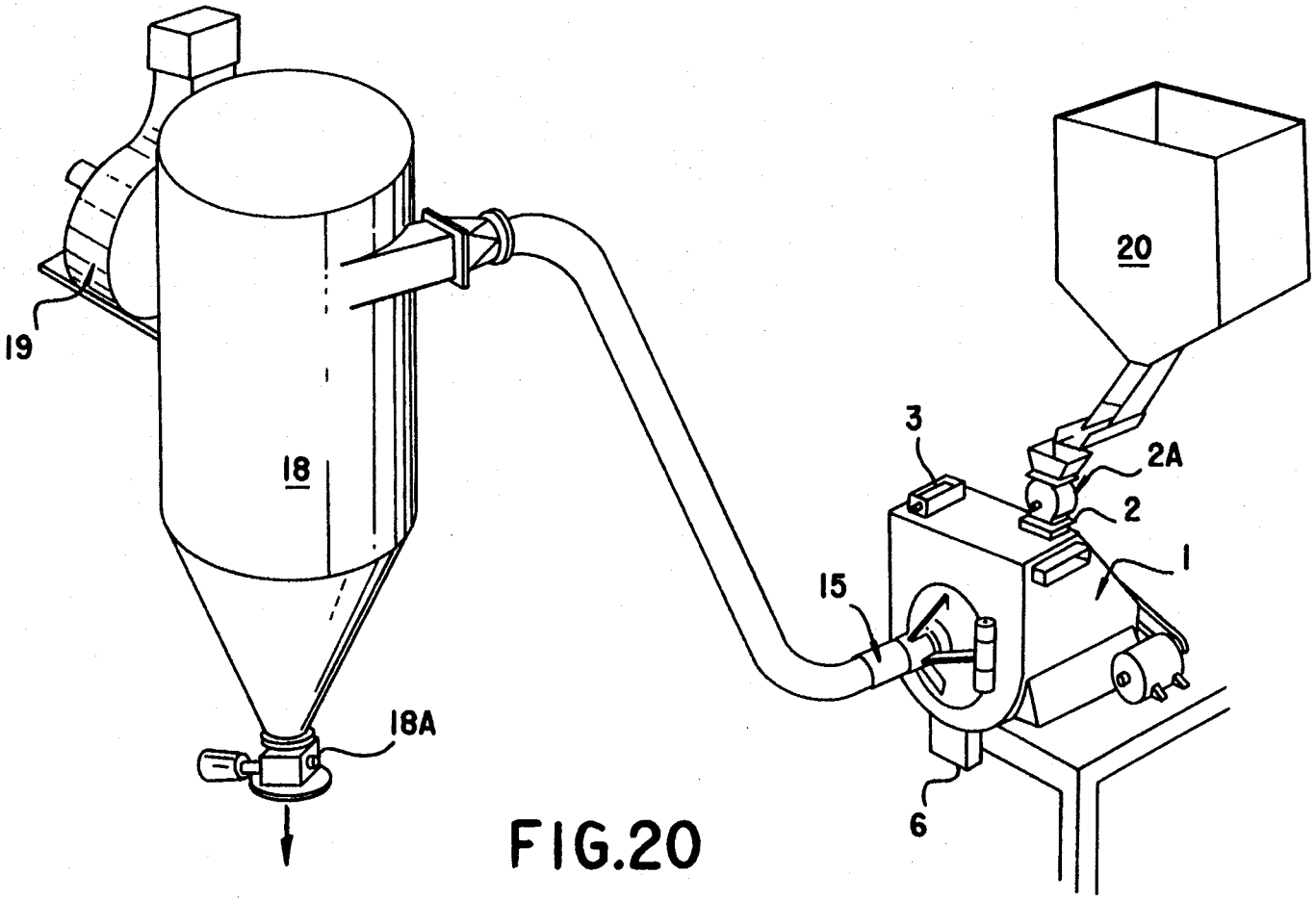
FIGS. 20 and 21 are schematic general arrangements of the apparatus in relation to auxilary equipment in open circuit and closed circuit operations respectively.
Figure 21:
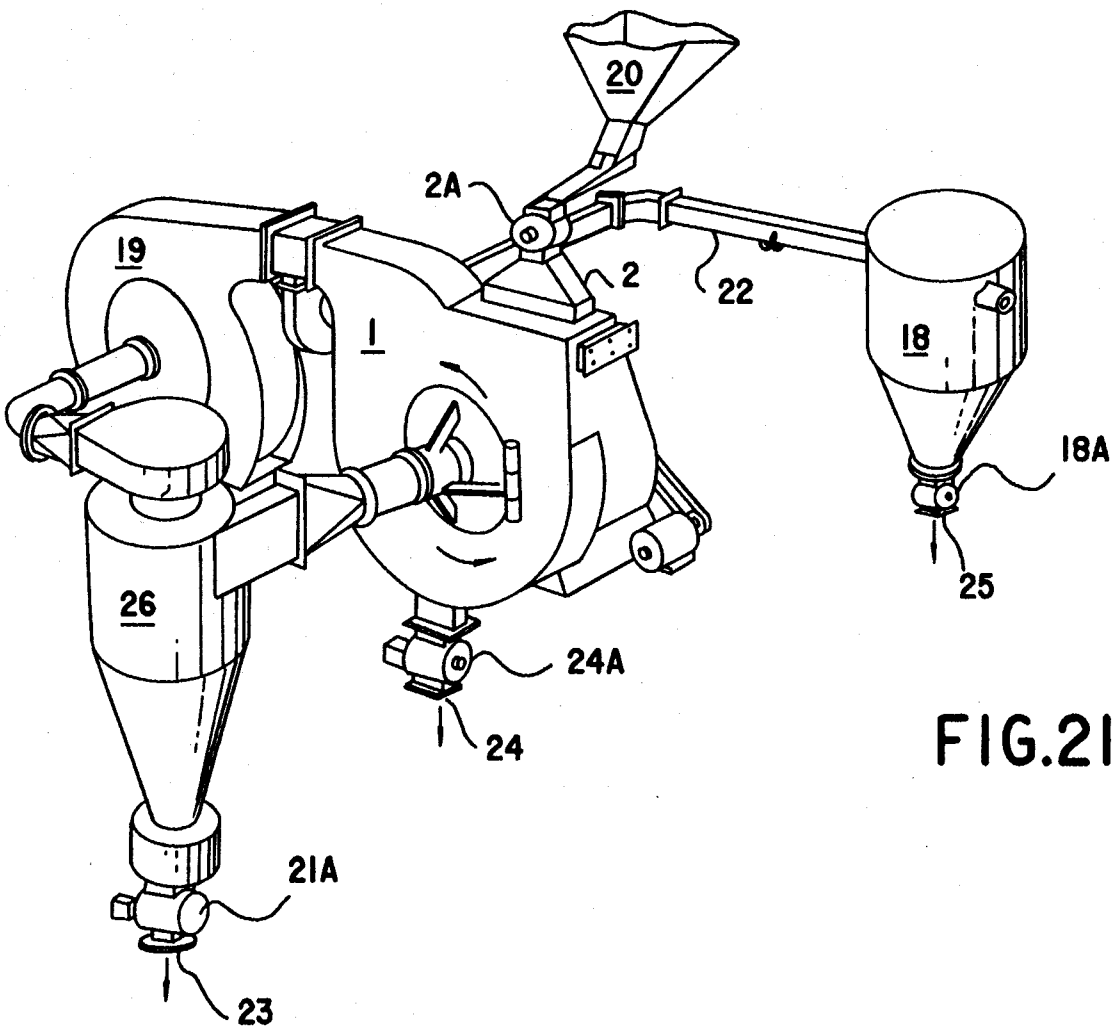

It will be appreciated that when a depression or negative air pressure exists in the outlet duct 5 by the action of fans or any prime mover downstream from the filter 18 as shown at 19 in FIGS. 20 and 21, air is drawn down through the entries 8E at the rotor and the resultant centripetal air drag on the material particles rotating around the rotor acts against the centrifugal force on the particles as shown in FIG. 5 where particle P is at the point of classification with the arrows indicating the two forces. In impact or attrition mill modes, the particles are being reduced in size and since the air drag varies as the square of the particle diameter while the centrifugal force varies as the cube of the particle diameter it follows that the centrifugal forces on the diminishing particle sizes diminishes more rapidly than the centripetal air drag and, at the desired maximum particle size or less, the rotating particles move down the air paths 8F in the rotor and are conveyed out via the duct 5 to an external collector 18 or 26 in FIGS. 20 or 21.

FIG. 5 shows a typical rotor with beaters 8A against beater support plates 8B with centrifugal force carried by cylindrical spigots 12. The area of the air entries 8E for a given air quantity governs the air velocity entering the entries 8E.

FIG. 5 shows how the area of the gaps 8E can be decreased to provide a higher centripetal air velocity and hence a larger maximum particle size by the use of fairings 11. These may be fixed or, more conveniently, removable as shown. The outer peripheral surface of the fairings, if they are used, is protected by abrasion resistant material.

Very fine particle sizes can be obtained by large gaps areas 8E between the beaters 8A and with the rotor running at high speed and with reduced air quantity if necessary.

Large particle sizes, conversely, are classified out by using small areas 8E, a slow running rotor and large air quantities. Variations of the rotor gaps and fairings 11 are shown in FIGS. 7, 8 and 9.

Figure 4:
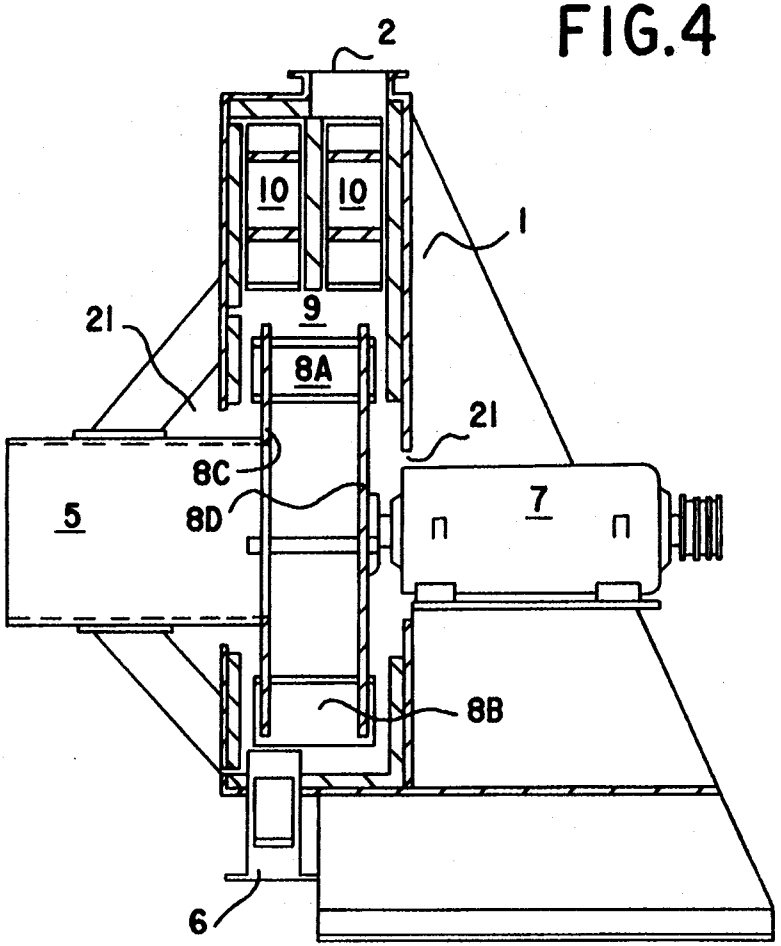
FIGS. 3, 3A, 4 and 4A are respectively schematic sectioned side and end elevations of the apparatus in FIG. 1.
Figure 3:
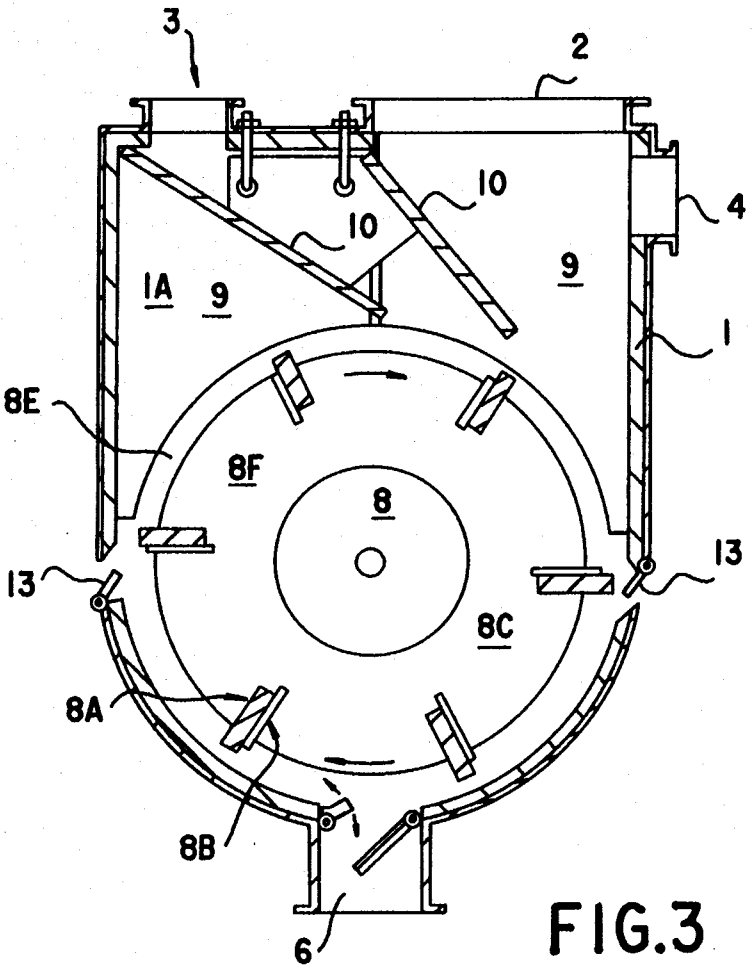
Figure 4A:
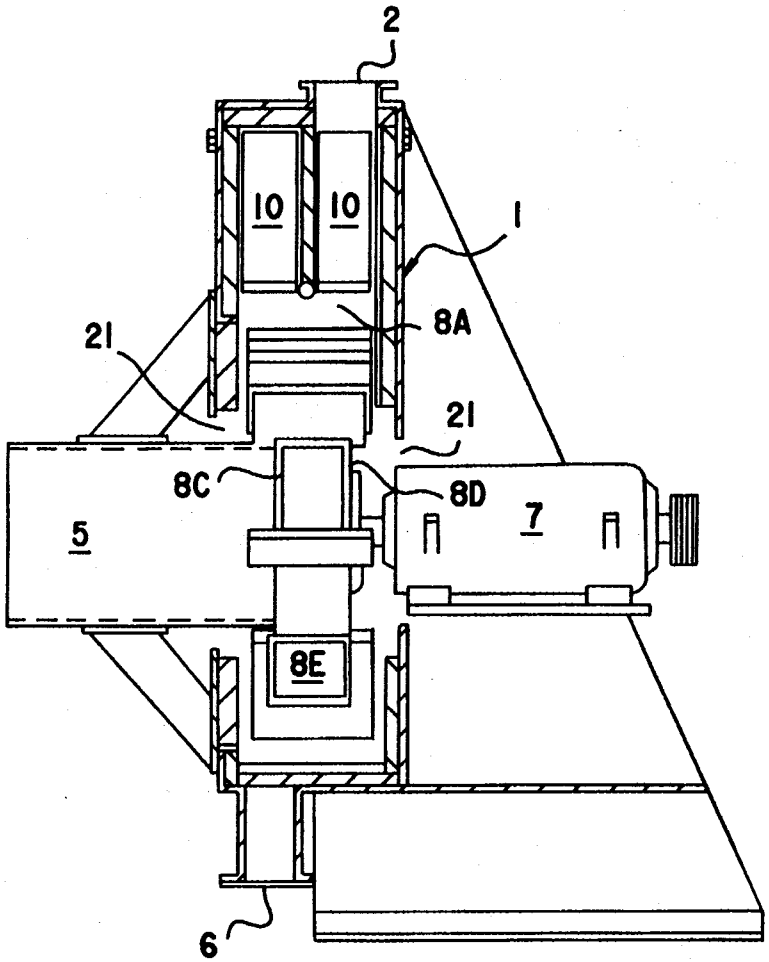
Figure 3A:
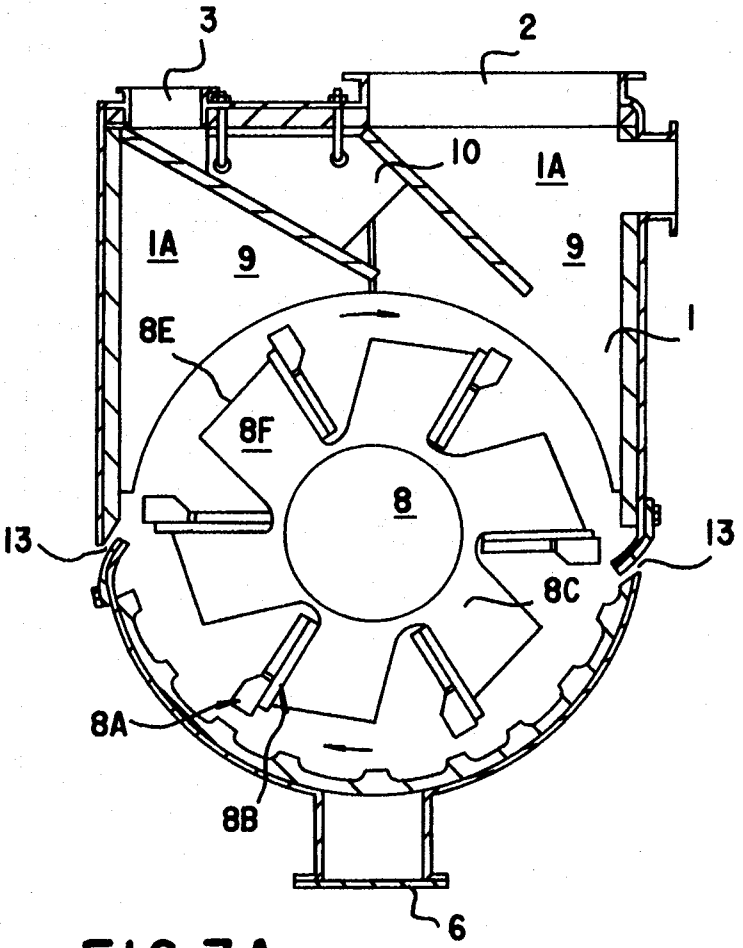
Figure 6A:
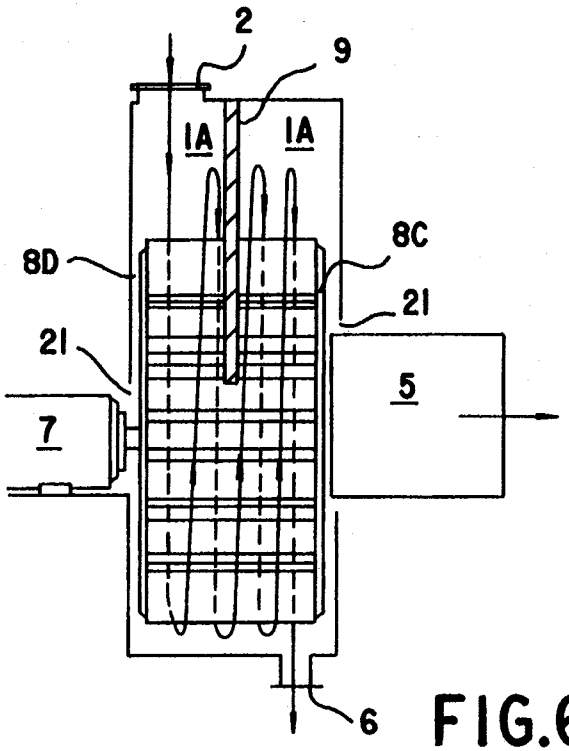
FIGS. 6 and 6A are diagrammatic illustrations of the internal action of the apparatus in FIG. 1 when running in differential impact, differential attrition and air classifier modes, in perspective and end elevation respectively.
Figure 6:
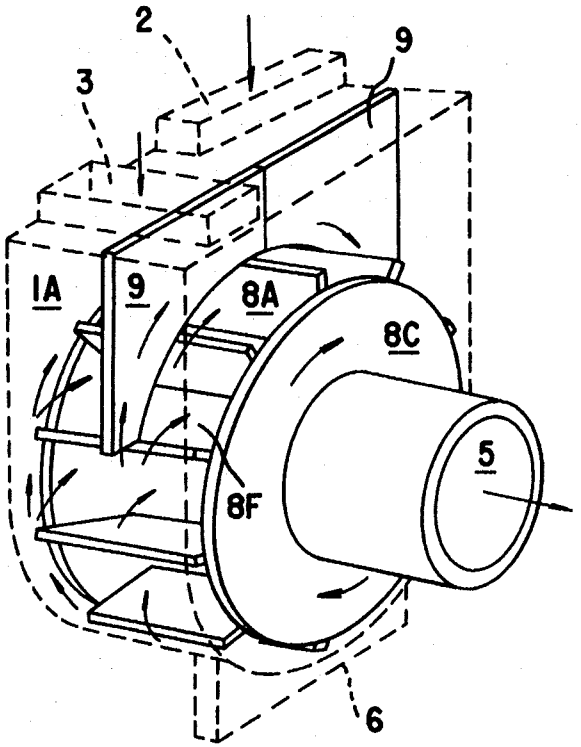
Figure 12:
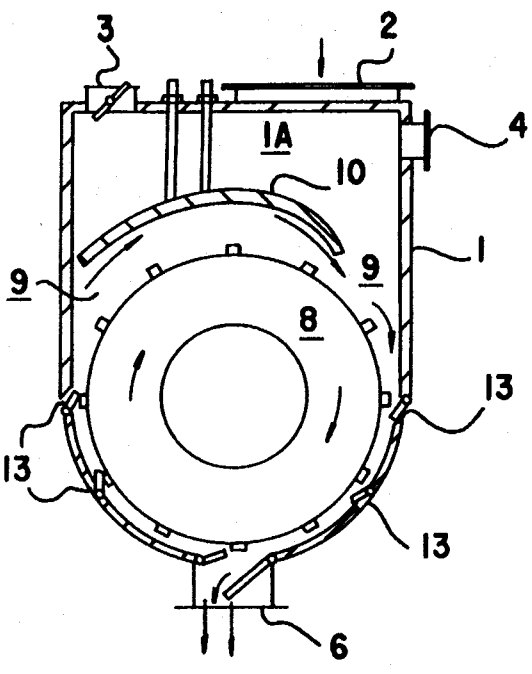
FIGS. 10, 11 and 12 are schematic sectioned elevations of three different top impact plate and low level outlet combinations of the apparatus in FIG. 1.

A further feature of the invention provides for the housing 1 to define an upper level expansion chamber 1A which communicates with the inlet 2. Preferably the expansion chamber 1A will be divided into at least two chambers by means of a radial partition 9 as shown in FIGS. 3, 4 and 6, the partition being generally parallel with the plane of the rotor 8. Preferably both chambers will be divided along their peripheral lengths into sub chambers by means of generally inclined, curved or radially disposed impact or guide plates 10 which may be adjustable vertically or angularly and can be of different lengths to suit the characteristics of the materials being treated. These play an important part in the processes. See FIGS. 3 and 4, 6, 10, 11 and 12, and as described further or below.

An important feature of the invention comprises the provision of a number of strategically placed air inlets into the housing which are designed to minimize compaction and over-grinding through excessive attrition resulting from undue retention of ground material in the housing 1 should a high percentage of fines not be required. The invention envisages that axial inlets 21 in FIGS. 1, 2, 4, 5 and 6 into the housing 1 will be provided at the axis of the rotor 8 to direct airflow from the center of the housing towards the periphery thereof. Further air inlets 3 and 4 are provided at the upper level in the expansion chamber zones 1A, see FIGS. 1, 2, 3, 4, 5, 6, 10, 11 and 12, to permit constant and effective penetration of air through the moving material that has expanded into the zones 1A to avoid compaction. Preferably these inlets 3 and 4 will be adjustable by means of suitable damper plates. In addition air can enter via the feed inlet 2 which can be controlled by use of a tilting flap valve or if no air is required or if there is ricochet of particles emerging from the housing, by the use of a rotary seal at this inlet as at 2A in FIGS. 20 and 21.

Further air inlets 13 tangential to the rotation of the rotor are provided in the lower periphery of the housing 1. These can be adjusted for example by means of a flap 13A shown in FIG. 14 protected by an abrasion resistant surface. The flaps 13A not only admit air but deflect the rotating material to assist the ingress of the air when treating certain materials. The air inlets 13 are used in conjunction with the adjustments of the other controlled air inlets to obtain the most suitable penetration of the material being treated to prevent a high percentage of fines should this be undesirable or, particularly, when the unit is being used in air classifier mode to ensure the efficient removal of the finer fraction of the feed material before a coarser fraction is withdrawn via a lower level outlet 6.

Figure 11:
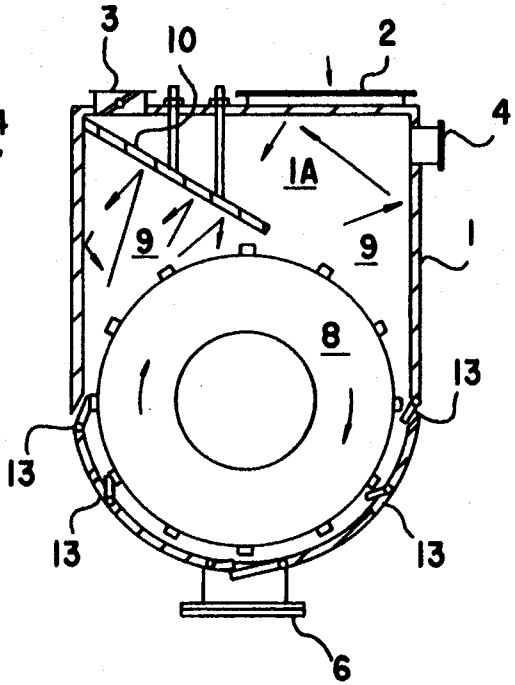
Figure 10:
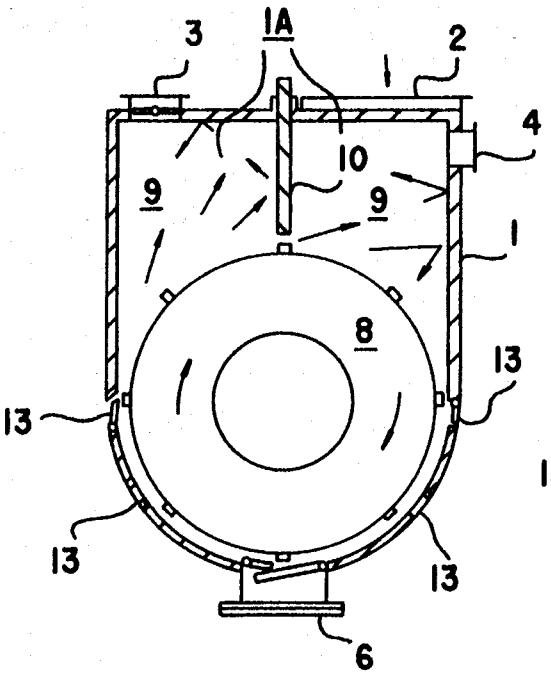

In the differential impact mill mode, the differential attrition mill mode and particularly the air classifier mode in all of which it is the aim to efficiently remove the larger, denser or harder material out via the low level outlet 6 it is important to maintain a rotation of the material keeping the larger, denser or harder material closer to the periphery. FIG. 11 shows the inclined impact plate 10 which may be preferred in the differential impact mill mode as opposed to the fiercer impact plate 10 of FIG. 10 which creates violent ricochet which might be preferred in the impact mill mode. It would invariably be used in the differential attrition mill mode. The curved guide plates 10 of FIG. 12 might be used in a differential attrition mill treating very friable material and would invariably be used in the air classifier mode. Thus the invention provides a variation of plates 10 to achieve efficiency in treating various materials.

Figure 17:
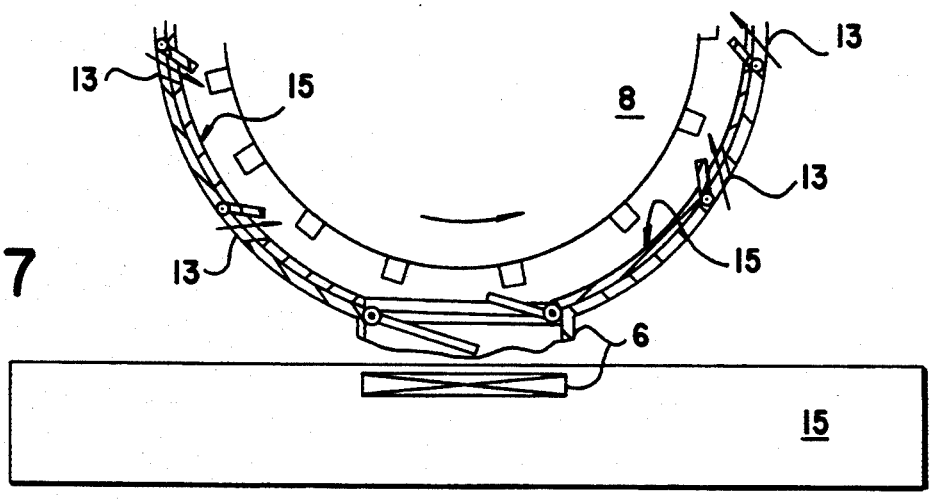
Figure 18:
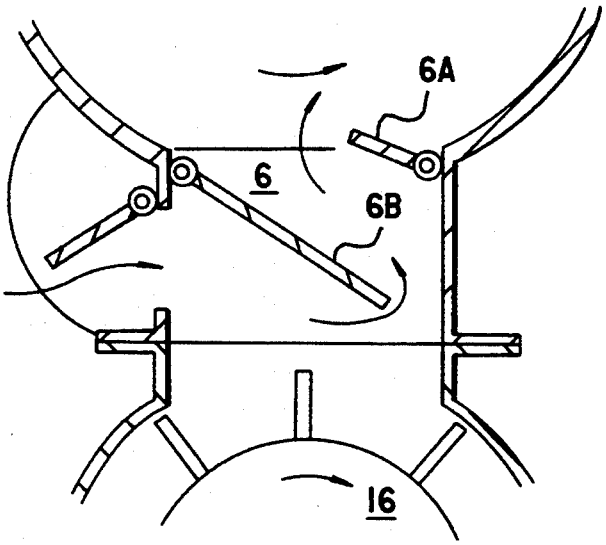
FIGS. 18 and 19 are schematic sectioned elevations of two alternative lower level outlet arrangements.
Figure 19:
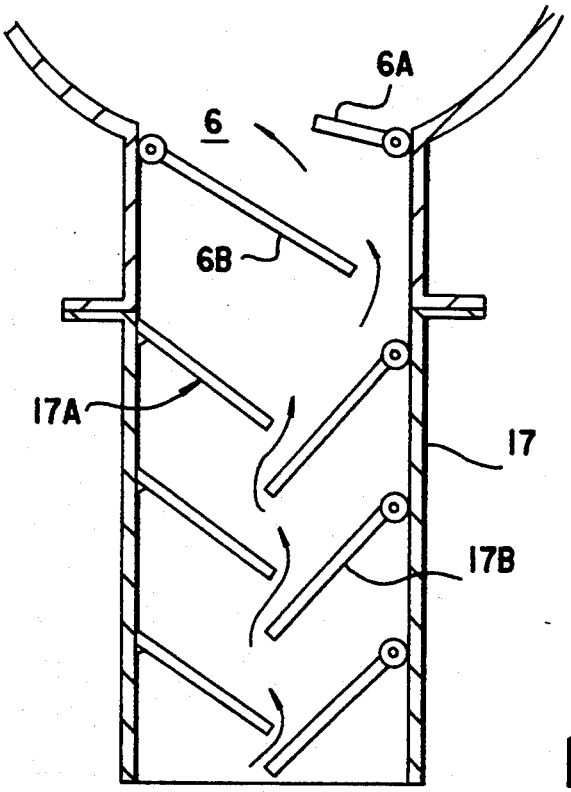

In the differential impact mill, differential attrition mill and air classifier mode the invention provides for the use of a low level outlet 6 see FIGS. 3, 4, 6, 18 and 17, to remove oversize, dense or hard material from the housing 1. FIG. 6 shows how the material, which is indicated by arrows, enters the inlet 2 and is rotated in the housing by the rotor beaters, 8A. Since the housing 1 is under negative air pressure, air enters the housing and removes the classified material as previously described. The division plates 9 divide the upper zone of the housing into at least two expansion chambers 1A parallel to the plane of the rotor 8. Since the feed inlet 2 is at the back end of the housing 1 and the outlet 6 is at the front end of the housing, the material moves in a spiral path from the back to the front end. The finer fraction is removed via the rotor air passages 8f and out via duct 5. The surviving coarser, denser, harder fraction survives the spiral path and the expansion into the upper chambers 1A until it reaches the outlet 6 where it either gravitates out or is assisting by the vane 6A (FIGS. 18 and 19). It may finally be airwashed by air entering via the outlet 6 controlled by further vanes such as 17A and 17B in an extension chute 17 (FIG. 19). It may, alternatively be removed without further air washing via a rotatary seal 16.

Figure 15:
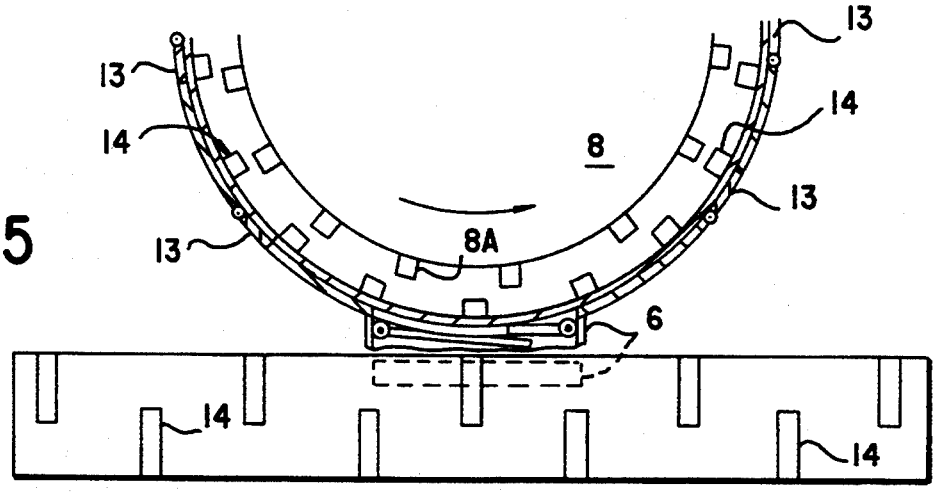
FIGS. 15, 16 and 17 are diagrammatic sectioned elevations of lower level peripheral liners, peripheral air inlets and lower level outlets for impact and attrition mills, differential impact and attrition mills and air classifier modes respectively.

The interior surfaces of the housing 1 are protected by abrasion resistant liners. Those on the sides of the housing are generally flat without projections. The peripheral liners are indicated diagramatically in FIGS. 15, 16 and 17 which show sectioned elevations and flat plan views of the liners. FIG. 15 indicates liners with projections 14 and a closed outlet 6 for attrition mill mode and possibly for impact mill mode if the material being treated is hard. The air inlets 13 may be closed during this mode.

Figure 16:
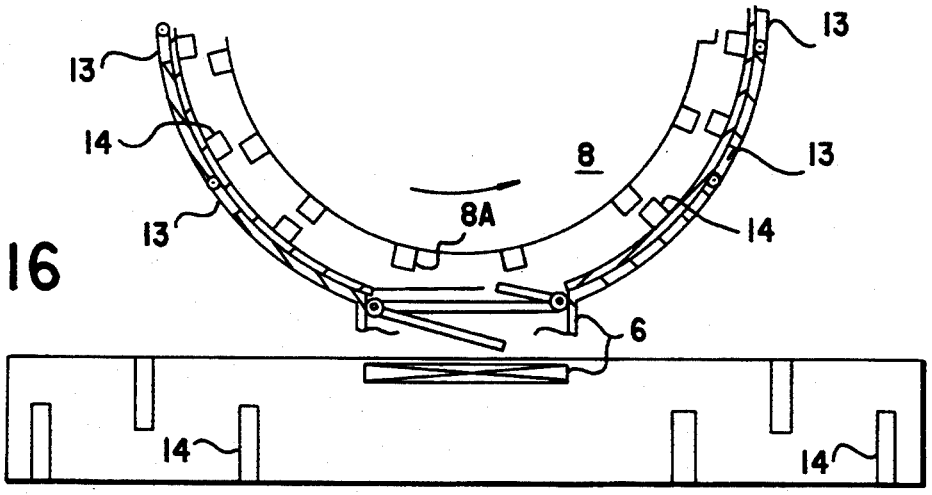

FIG. 16 shows liners with projections 14 and outlet 6 open for the differential attrition mill mode with the air inlets 13 open or closed. FIG. 17 shows liners 15 without projections and outlet 6 open for the air classifier mode and differential impact mill mode with the air inlets optionally open. For the impact mill mode the arrangement could be as FIG. 17 with the outlet 6 closed and air inlets 13 closed.

FIG. 20 shows the apparatus according to the invention operating in any of the five modes described in a normal open circuit with the necessary auxilliary equipment. A feed bin 20 allows raw material to be fed via a vibrating feeder or any suitable feeder to the unit housing 1. A rotary seal 2A may optionally be used. The classified fine product is conveyed out via duct 5 to a collector, usually a filter collector 18 and gravitates out via a rotary seal 18A. A fan or fans in series or a positive displacement blower as required, 19, provides the necessary depression or negative air pressure in the system. Oversize, dense or hard material emerges, if desired, via a outlet 6.

When running in air classifier mode the apparatus according to the invention may run in closed circuit as indicated in FIG. 21. Here all inlets and outlets are fitted with rotary seals. A high efficiency cyclone collector 26 may be used to collect the product. A fan 19 handles very fine particles escaping from a collector 26 and a bleed-off duct 22 with damper bleeds-off inwardly leaking and displacement air fed to a small filter 18. The system operates in a balanced condition. The fine fraction emerges at 23, the large fraction at 24 and a lesser quantity of very fine material at 25. An air bleed-in can be used if necessary.

Doubtless many variations of the invention exist without departing from the principles set out in the consistory clauses.

I claim:

1. A mill or classifier unit comprising:

a housing defining an inlet for raw material in an upper portion thereof and at least one outlet for horizontally expelling treated material outside said housing;

a rotor with a plurality of outwardly radiating beater elements which rotate around a horizontal axis, said rotor being mounted within said housing; and an expansion chamber into which material is directly vertically thrown by the beater elements of the rotor in use, said expansion chamber provided inside said housing between said inlet and said rotor, and said expansion chamber positioned vertically above said beater elements and located vertically above said rotor, wherein said at least one outlet horizontally expelling said treated material in an axial direction to the rotation of said rotor.

2. The unit according to claim 1 wherein the expansion chamber is disposed at the upper portion of the housing.

3. The unit according to claim 1 wherein the inlet communicates with the expansion chamber.

4. The unit according to claim 1 wherein the expansion chamber defines at least one partition disposed generally parallel to a plane of the rotor.

5. The unit according to claim 1 wherein the expansion chamber includes at least one partition disposed generally parallel to an axis of rotation of the rotor to act as impact plates.

6. The unit according to claim 1 wherein the unit acts as one of a differential mill and air classifier and the expansion chamber includes at least one guide plate to direct unclassified material entering the expansion chamber in a direction of rotation of the rotor.

7. The unit according to claim 1 wherein the rotor defines arm members for carrying the heater elements, the arm members being of tubular construction each defining an air passage through which sized material may be withdrawn.

8. The unit according to claim 1 wherein air inlets located in the upper portion of the housing are provided in the expansion chamber to direct airflow within the housing tangentially about the rotor.

9. The unit according to claim 1 wherein opposed axial air inlets are provided to direct airflow within the housing from an axis of the rotor radially outwardly.

10. The unit according to claim 1 wherein the unit acts as an air classifier and at least one controlled peripheral air inlet in the housing are provided to wash material away from a periphery of the housing.

11. The unit according to claim 1 wherein the unit acts as one of a differential mill and air classifier, including an outlet for oversize, denser or harder material located at a low level in the housing, wherein the material is air washed as the material passes through the outlet.

12. The unit according to claim 11 wherein control vanes are provided at the outlet, one control vane directing material towards the outlet while another vane is adapted to direct airflow into the housing.

13. The unit according to claim 1 wherein the outlet is axially disposed and coupled to suction means for drawing treated material through a rotating outlet.

14. The unit according to claim 13 wherein the rotating outlet, through which the material is drawn, is incorporated in the rotor.

15. The unit according to claim 1 wherein the rotor defines arm members in a form of mounting plates for carrying the beater elements, the mounting plates being flanked by front and rear side discs so that air passages are defined between such discs and adjacent mounting plates, down which treated material may be drawn towards an axis of the rotor.

16. The unit according to claim 15 wherein the arm members of the rotor are substantially radially disposed.

17. The unit according to claim 15 wherein the arm members of the rotor are inclined forwardly relative to a direction of rotation of the rotor.

18. The unit according to claim 15 wherein the arm members of the rotor are inclined rearwardly relative to a direction of rotation of the rotor.

19. The unit according to claim 15 wherein an area of inlets of the air passages of the arm members is variable by providing adjustable fairings, or vanes at these zones.

20. The unit according to claim 19 wherein the fairings or vanes provide a streamlined inlet for material into the air passages of the arm members.

21. A method of milling comprising the steps of:

providing a mill having a rotor including a plurality of outwardly radiating beater elements which rotate around a horizontal axis, said rotor rotatably mounted within a housing, the housing containing an expansion chamber located at an upper level of the housing between an inlet and the rotor, and said expansion chamber positioned vertically above said beater elements and located vertically above the rotor;

introducing raw material into the housing;

causing the beater elements to directly vertically throw the raw material into the expansion chamber repeatedly during the milling process; and horizontally withdrawing treated material outside said housing from an outlet of the mill in an axial direction to a rotation of the rotor.

22. A method of milling according to claim 21 further comprising the steps of withdrawing sized material from the housing co-axially with an axis of rotation of the rotor, such sized material being withdrawn along passages extending from an outer periphery of the rotor towards an axis thereof.

23. A method of milling according to claim 21 further comprising the step of introducing air into the housing from a zone of an axis of rotation of the rotor for flow outwardly towards a periphery of the rotor.

24. A method of milling according to claim 21 further comprising the step of introducting air into the housing at the upper level of the housing for circular flow in conjunction with an outer peripheral zone of the rotor.

25. A method of classifying comprising the steps of:

providing a mill having a rotor including a plurality of outwardly radiating beater elements which rotate around a horizontal axis, said rotor rotatably mounted within a housing having an expansion chamber located in an upper level of the housing and said expansion chamber positioned vertically above said beater elements and located vertically above the rotor wherein raw material being repeatedly directly vertically thrown into said expansion chamber by said beater elements;

introducing raw material into the housing along a pathway extending in a direction of rotation of the rotor; and horizontally withdrawing treated material outside said housing from an outlet of the mill in an axial direction to a rotation of the rotor.

26. A method of classifying according to claim 25 further comprising the step of introducing air into the housing at a lower level of the housing to wash material away from lower peripheral zones of the housing.

* * * * *